US007246438B2

(12) United States Patent
Nozaki et al.

(10) Patent No.: US 7,246,438 B2
(45) Date of Patent: Jul. 24, 2007

(54) METHOD FOR PRODUCING A HEAT EXCHANGER WITH A LOUVERED FIN

(75) Inventors: Kimio Nozaki, Kanagawa (JP); Kenji Tochigi, Kanagawa (JP)

(73) Assignee: Calsonic Kansei Corporation, Tokyo (JP)

( * ) Notice: Subject to any disclaimer, the term of this patent is extended or adjusted under 35 U.S.C. 154(b) by 100 days.

(21) Appl. No.: 11/006,704

(22) Filed: Dec. 8, 2004

(65) Prior Publication Data

US 2005/0097746 A1 May 12, 2005

Related U.S. Application Data

(62) Division of application No. 10/060,083, filed on Jan. 31, 2002, now abandoned.

(30) Foreign Application Priority Data

Jan. 31, 2001 (JP) ..... 2001-024481

(51) Int. Cl.
*B21D 53/06* (2006.01)
*B21D 53/02* (2006.01)

(52) U.S. Cl. ..... 29/890.047; 29/890.03

(58) Field of Classification Search ..... 29/890.047, 29/890.03, 890.07, 412–415, 417; 165/43, 165/140, 135, 173, 149, 144, 176
See application file for complete search history.

(56) References Cited

U.S. PATENT DOCUMENTS 5,000,257 A 3/1991 Shinmura
5,033,540 A 7/1991 Tategami et al.
5,176,020 A 1/1993 Maruo et al.
5,509,199 A 4/1996 Beamer et al.
6,209,628 B1 4/2001 Sugimoto et al.
6,213,196 B1 4/2001 Ozaki et al.
6,357,518 B1 3/2002 Sugimoto et al.
6,360,817 B1 3/2002 Brochin et al.
6,871,399 B2 * 3/2005 Iwasaki et al. ..... 29/890.03

FOREIGN PATENT DOCUMENTS

| | | |
|---|---|---|
| DE | 100 03 104 | 8/2000 |
| EP | 0 431 917 | 6/1991 |
| EP | 1 164 345 | 12/2001 |
| GB | 1 301 666 | 1/1973 |
| JP | 6-109390 A | 4/1994 |
| JP | 11-147149 A | 6/1999 |

* cited by examiner

*Primary Examiner*—John C. Hong
(74) *Attorney, Agent, or Firm*—Foley & Lardner LLP

(57) ABSTRACT

A method for producing a heat exchanger. A louvered fin is provided, where the louvered fin has a first bridge member for attaching a first corrugated strip and a straightening member of the louvered fin together. A first corrugated strip is fixed between first and second adjacent tubes of the heat exchanger such that the first corrugated strip is kept in a straight shape by the first and second tubes. The straightening member is detached from the first corrugated strip by breaking the first bridge member such that there is provided a first sandwiched structure having the first corrugated strip fixed between the first and second tubes.

11 Claims, 9 Drawing Sheets

METHOD FOR PRODUCING A HEAT EXCHANGER WITH A LOUVERED FIN

The present application is a divisional of U.S. application Ser. No. 10/060,083,filed Jan 31, 2002, now abandoned, the entire contents of which are incorporated herein by reference.

BACKGROUND OF THE INVENTION

The present invention relates to a vehicular heat exchanger, particularly to a louvered fin for a heat exchanger, which has (a) a corrugated strip having planar and connecting portions that are alternately arranged to make a corrugation and (b) a plurality of louvers formed in each planar portion such that the louvers are arranged in a lateral direction, to a heat exchanger having such louvered fin, and to a method for producing such heat exchanger.

In an automotive water-cooled engine, a heat exchanger such as radiator is disposed at a front position in an engine room, and this radiator serves to cool an engine cooling water. As generally known, this radiator has a pair of tanks (headers), a plurality of tubes extending between the tanks, and a plurality of fins each being disposed between two adjacent tubes. At the position of each fin, a heat exchange is conducted between air flowing through the fins and the cooling water passing through the tube.

SUMMARY OF THE INVENTION

It is an object of the present invention to provide a louvered fin for a heat exchanger, which louvered fin is prevented from curling in the production of the heat exchanger, even if louvers of the louvered fin are in asymmetry in its lateral direction.

It is another object of the present invention to provide a heat exchanger produced by using such louvered fin.

It is still another object of the present invention to provide a method for producing such heat exchanger.

According to the present invention, there is provided a louvered fin for a heat exchanger. This louvered fin comprises:

a first corrugated strip having planar and connecting portions that are alternately arranged to make a corrugation, the first corrugated strip extending straight in a longitudinal direction;

a plurality of first louvers formed in each planar portion such that the first louvers are arranged in a lateral direction perpendicular to the longitudinal direction, the first louvers in each planar portion being configured to be in asymmetry in the lateral direction;

a straightening member for keeping the first corrugated strip in a straight shape in the longitudinal direction, the straightening member extending along a longitudinal side of the first corrugated strip; and a first bridge member for attaching the first corrugated strip and the straightening member together such that a detachment of the straightening member from the first corrugated strip is allowed by breaking the first bridge member after the first corrugated strip is fixed between first and second adjacent tubes of the heat exchanger in a production of the heat exchanger.

According to the present invention, there is provided a heat exchanger comprising a first assembly. The first assembly includes:

first and second tanks;

first and second tubes extending between the first and second tanks such that a heat-exchanger medium is allowed to flow from the first tank to the second tank;

the first corrugated strip fixed between the first and second tubes, the first corrugated strip having a fracture surface at a longitudinal side of the first corrugated strip; and the first louvers. This heat exchanger is produced by a method comprising the steps of:

(1) providing a louvered fin comprising (a) the first corrugated strip; (b) the first louvers; (c) a straightening member for keeping the first corrugated strip in a straight shape in the longitudinal direction, the straightening member extending along a longitudinal side of the first corrugated strip; and (d) a first bridge member for attaching the first corrugated strip and the straightening member together;

(2) fixing the first corrugated strip between the first and second tubes such that the first corrugated strip is kept in the straight shape by the first and second tubes; and (3) detaching the straightening member from the first corrugated strip by breaking the first bridge member such that there is provided a sandwiched structure having the first corrugated strip fixed between the first and second tubes and such that the fracture surface of the first corrugated strip is exposed.

DETAILED DESCRIPTION

Figure 12:
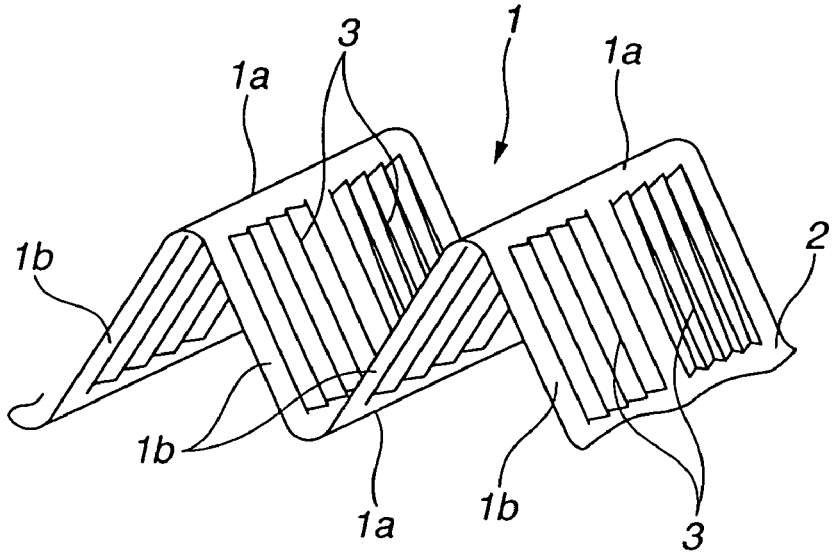
FIG. 12 is a partial perspective view showing a louvered fin not according to the present invention.

FIG. 12 shows a louvered fin 1 not according to the present invention. This louvered fin 1 is made of a thin strip 2 and has corner portions 1*a* and planar portions 1*b* that are alternately continuously arranged to make a corrugation. Each planar portion 1*b* has a plurality of louvers 3 that are arranged in the lateral direction and are orientated obliquely relative to the base flat wall of the planar portion 1*b*.

Figure 13:
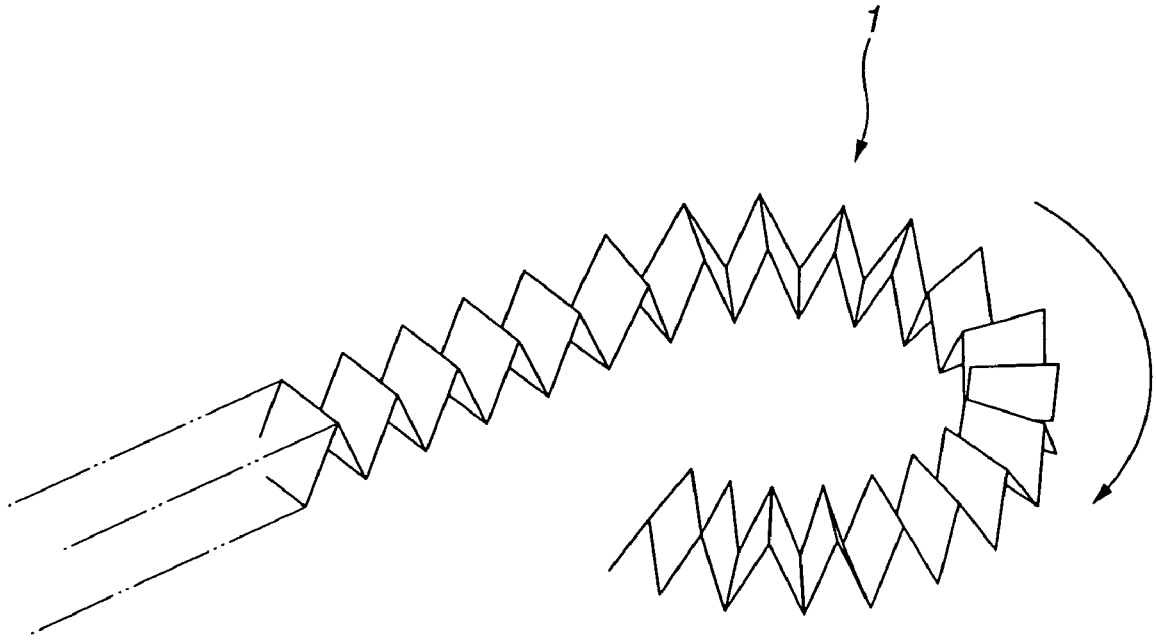
FIG. 13 is a perspective view showing a condition of curling of the louvered fin of FIG. 12.
Figure 14:
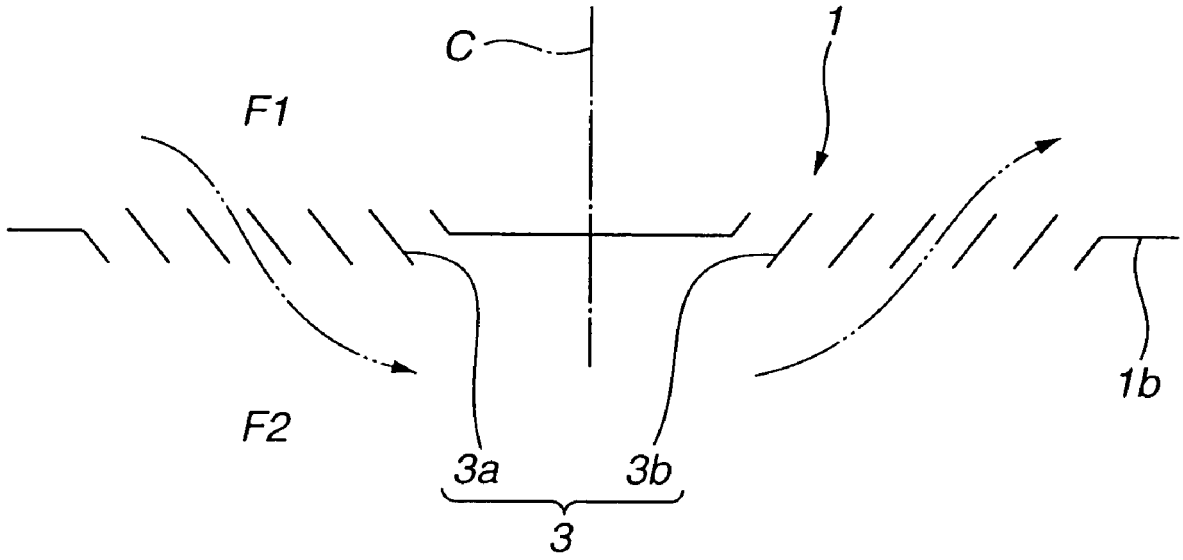
FIG. 14 is a laterally sectional view of the louvered fin of FIG. 12.

In case that all the louvers 3 in each planar portion 1*b* are orientated in a uniform direction, the louvered fin 1 becomes imbalanced in the lateral direction. With this, the louvered fin 1 tends to curl, as shown in FIG. 13. This makes impossible to conduct an automated assembly of this louvered fin 1 for producing a heat exchanger. In order to prevent this curling, there is a proposal in which the left half and right half louvers 3*a* and 3*b* are orientated in opposite directions to make a symmetrical configuration about a center line C of each planar portion 1*b*, as shown in FIG. 14. This proposal makes it possible to maintain the louvered fin 1 in a straight shape in its longitudinal direction.

However, according to the above proposal, air flows from a first side F1 of the planar portion 1*b* to a second side F2 through the louvers 3*a*, as shown by the arrow of two-dot chain line in FIG. 14. Then, air flows from the second side F2 to the first side F1 through the louvers 3*b* due to the orientation of the louvers 3*b*. Therefore, air flows through the louvered fin 1 in a meandering manner. This increases air flow resistance and thereby lowers heat exchange efficiency.

The present invention was made in view of such problem. The present invention makes it possible to prevent curling of a louvered fin of a heat exchanger in the production of the heat exchanger, even if its louvers are in asymmetry in the lateral direction, and thereby makes it possible to conduct an automated assembly of louvered fin for producing a heat exchanger.

As stated above, the louvered fin according to the present invention has the straightening member extending along a longitudinal side of the first corrugated strip. This straightening member is capable of preventing the above-mentioned curling of a louvered fin during the production of a heat exchanger, even if the first louvers in each planar portion are configured to be in asymmetry in the lateral direction and even if planar portions each having such asymmetrical louvers are continuously formed in the longitudinal direction of the louvered fin. Therefore, when the first corrugated strip is disposed or fixed between first and second tubes of a heat exchanger, it is possible to maintain the first corrugated strip in a straight shape. Therefore, it becomes possible to easily and precisely conduct an assembly of the louvered fin. It is possible to detach the straightening member from the first corrugated strip by breaking the first bridge member after the first corrugated strip is fixed between the first and second tubes. By this breaking, the first corrugated strip has a fracture surface only at one longitudinal side of the first corrugated strip. The other longitudinal side does not have such fracture surface. Therefore, the existence of this fracture surface makes it easy to recognize the proper orientation of the louvered fin and thereby to conduct the proper assembly of the louvered fin. For example, it is possible to easily recognize one longitudinal side (having the fracture surface) as the front or rear side in the production of a heat exchanger. This improves the assembly workability of a heat exchanger.

Figure 1:
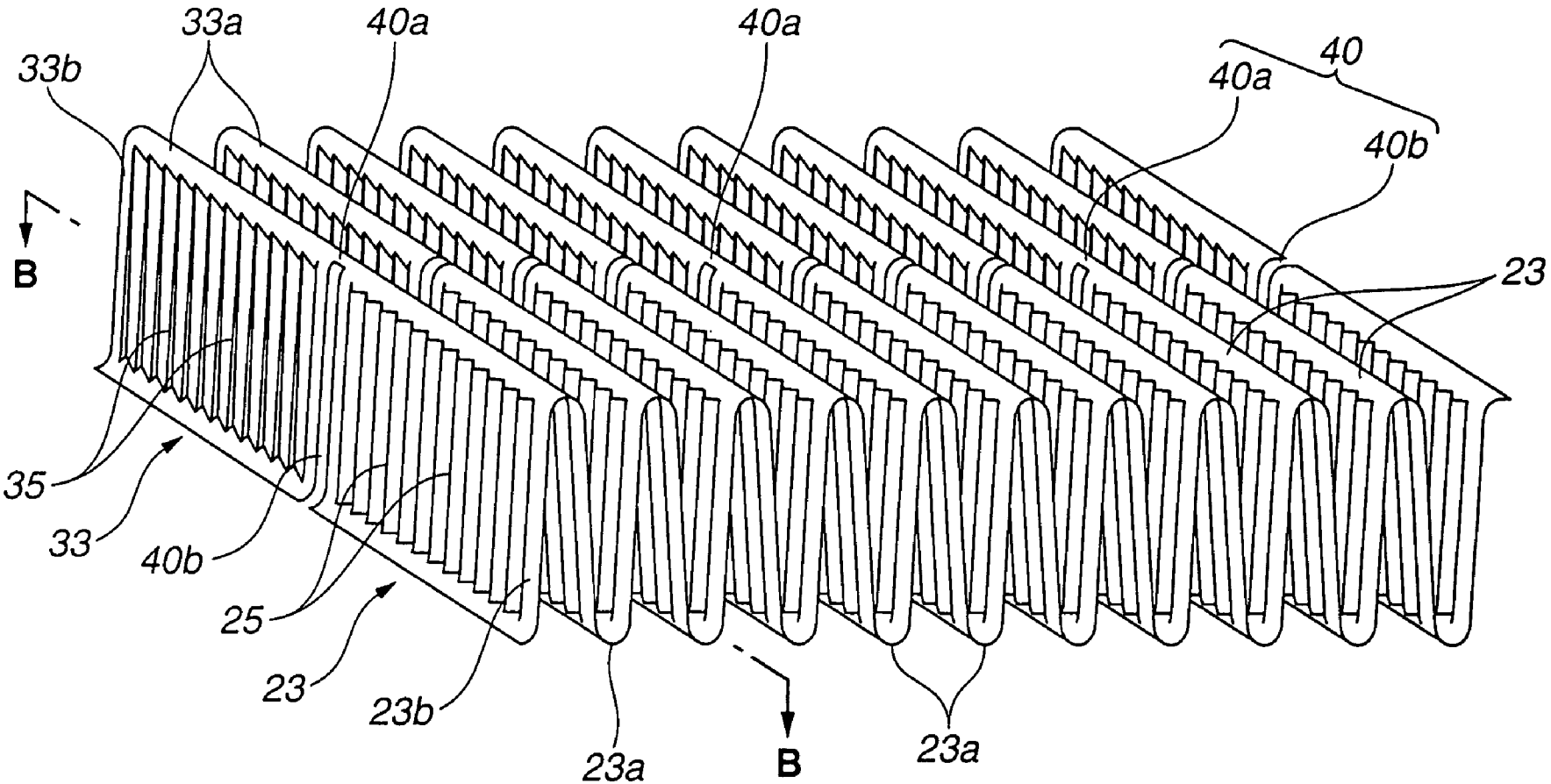
FIG. 1 is a perspective view showing a louvered fin according to an embodiment of the present invention.
Figure 2:
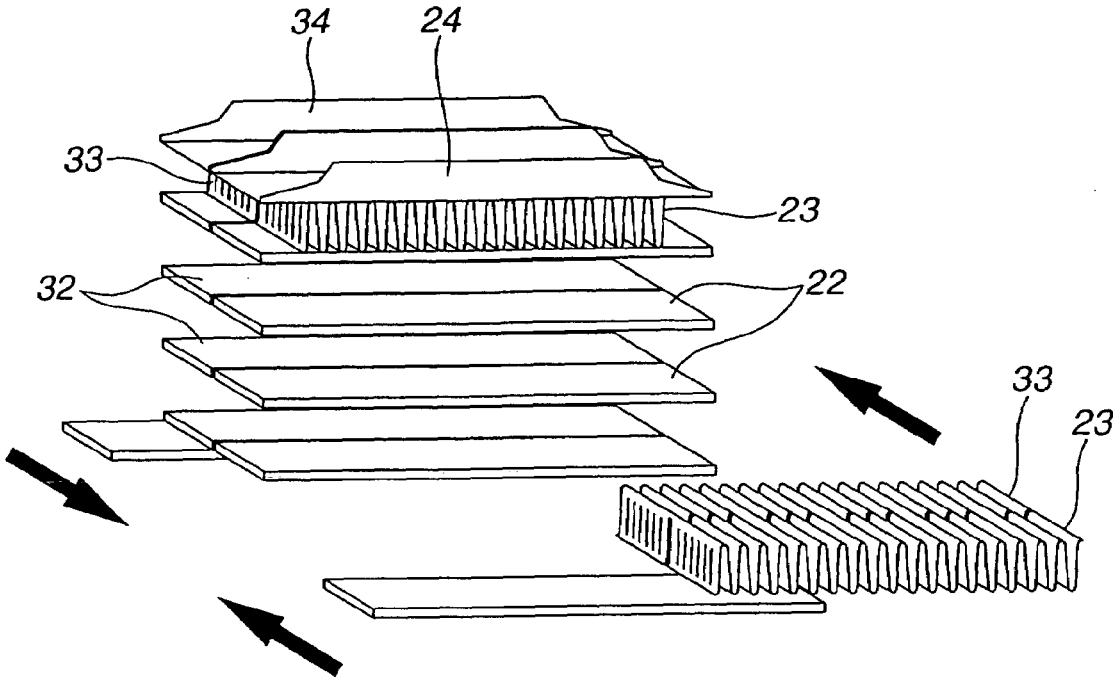
FIGS. 2-4 are perspective views showing sequential steps for producing a heat exchanger in accordance with an embodiment of the present invention.
Figure 3:
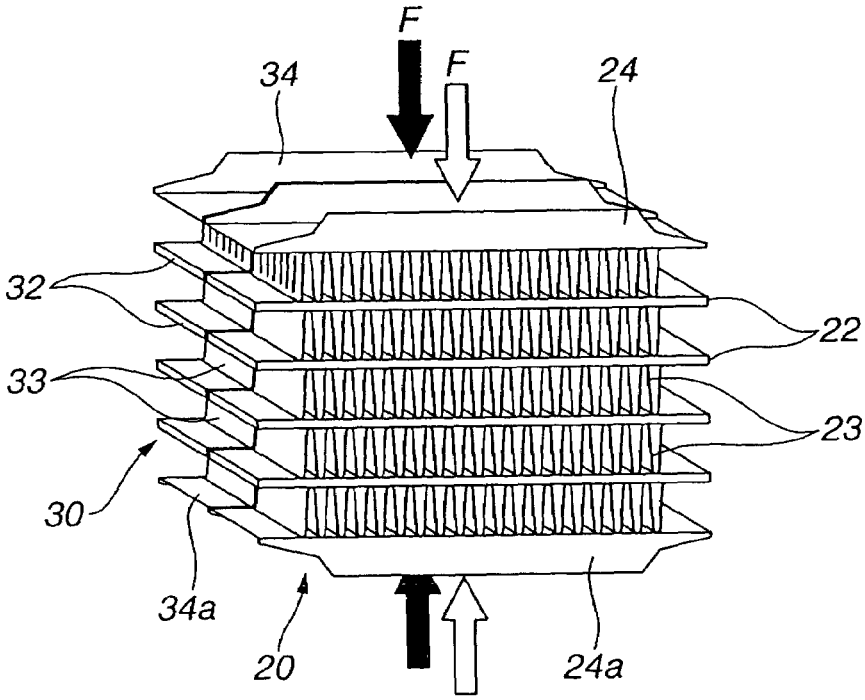
Figure 4:
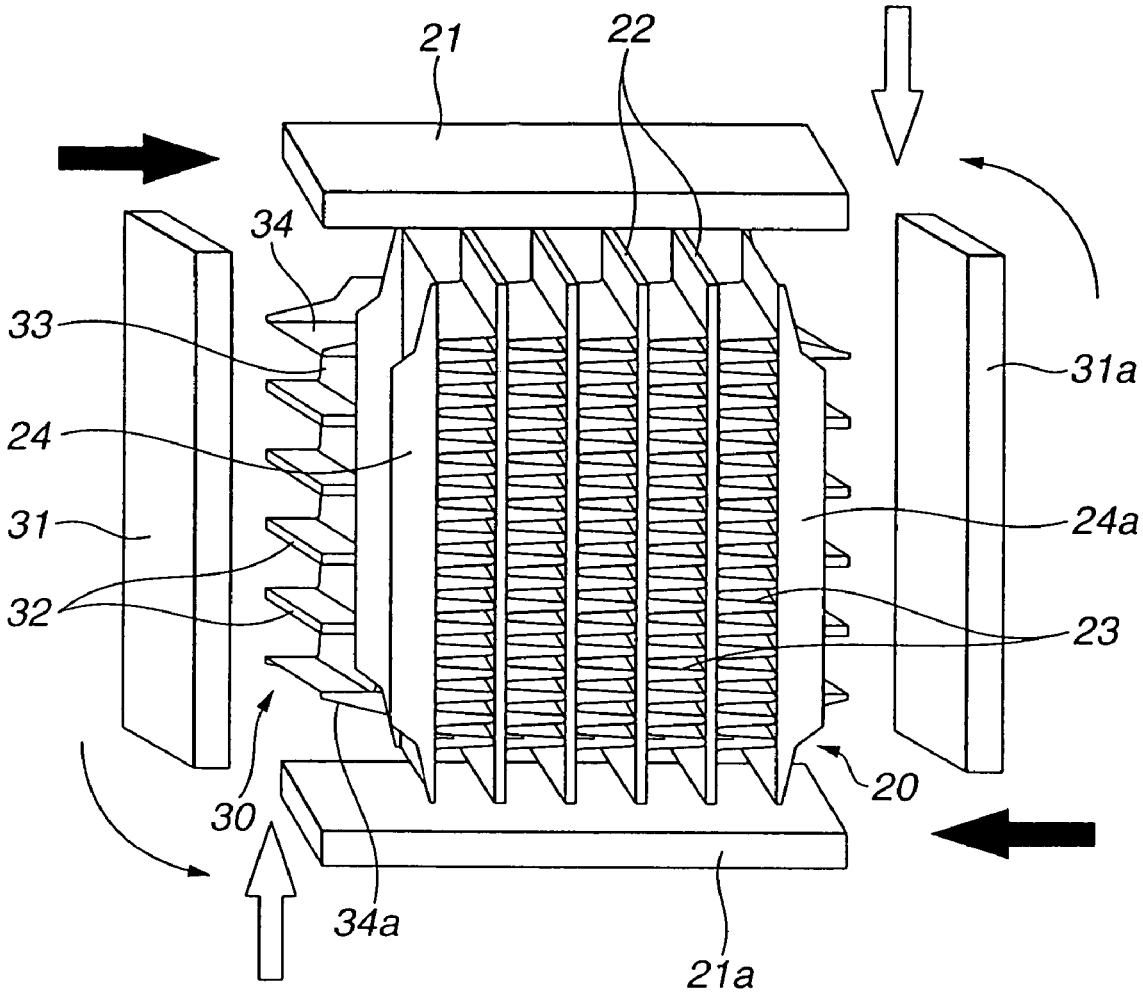

With reference to FIGS. 1-10, 11(*a*) and 11(*b*), exemplary embodiments according to the present invention will be described in detail in the following. FIG. 1 shows a louvered fin according to an embodiment of the present invention. This louvered fin has a first corrugated strip 23 and a second corrugated strip 33. The second corrugated strip 33 is capable of serving as the straightening member for keeping the first corrugated strip 23 in a straight shape in the longitudinal direction of the first corrugated strip 23. As shown in FIGS. 2-4, the first and second corrugated strips 23 and 33 are respectively simultaneously used for producing first and second radiators (first and second assemblies) 20 and 30. As will be explained hereinafter, a first sandwiched structure having the first corrugated strip 23 fixed between first and second adjacent tubes 22, 22 is detached from a second sandwiched structure having the second corrugated strip 33 fixed between third and fourth adjacent tubes 32, 32 for simultaneously producing the first and second radiators 20 and 30.

As shown in FIG. 4, the first radiator 20 has first and second tanks (headers) 21 and 21*a* and a plurality of tubes 22 extending between the first and second tanks 21 and 21*a* such that a heat-exchanger medium (cooling water) is allowed to flow from one of the first and second tanks 21 and 21*a* to the other tank. The first radiator 20 further has the first corrugated strip 23 that is fixed between first and second adjacent tubes 22, 22 by brazing. In other words, the first and second tanks 21 and 21*a* are attached to the above-mentioned first sandwiched structure for producing the first radiator 20. Furthermore, the first sandwiched structure is reinforced at its both sides with a pair of reinforcements 24 and 24*a*. The second radiator 30 has a construction substantially identical with that of the first radiator 20. Thus, it is possible by the present invention to easily simultaneously produce a pair of identical radiators. The second radiator 30 has third and fourth tanks (headers) 31 and 31*a* and a plurality of tubes 32 extending between the third and fourth tanks 31 and 31*a* such that a heat-exchanger medium (cooling water) is allowed to flow from one of the third and fourth tanks 31 and 31*a* to the other tank. The second radiator 30 further has the second corrugated strip 33 that is fixed between third and fourth adjacent tubes 32 by brazing. In other words, the third and fourth tanks 31 and 31*a* are attached to the above-mentioned second sandwiched structure for producing the second radiator 30. Furthermore, the second sandwiched structure is reinforced at its both sides with a pair of reinforcements 34 and 34*a*.

Figure 5:
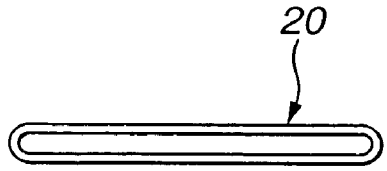
FIG. 5 is an end view showing a radiator tube according to an embodiment of the present invention.

As shown in FIG. 5, each tube 22 or 32 has a compressed configuration having opposite sides parallel with each other. Each tube is inserted at its both ends to insertion holes (not shown in the drawings) of the tanks and is fixed to the tanks by brazing. Upon this, each reinforce is also fixed at its both ends to the tanks by brazing. While a heat-exchanger medium flows through each tube, heat of this medium is transmitted to the first or second corrugated strip 23 or 33 and then to the air flowing therethrough, thereby conducing a heat exchange with the air and cooling of the heat-exchanger medium.

As shown in FIG. 1, the louvered fin has at its center in the longitudinal direction a perforated portion 40 at a boundary between the first and second corrugated strips 23 and 33. The perforated portion 40 has a plurality of bridge members 40*a* each being defined between adjacent slits 40*b* in the longitudinal direction. These bridge members 40*a* are broken for detaching the first and second corrugated strips 23 and 33 from each other, after each corrugated strip 23 or 33 is fixed between corresponding two adjacent tubes. This makes it possible to prevent curling of each corrugated strip 23 or 33.

Figure 6:
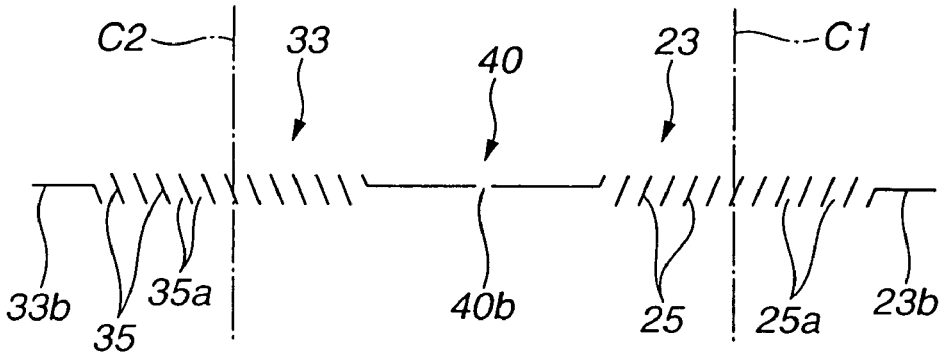
FIG. 6 is a sectional view taken along the lines B-B in FIG. 1.

Each of the first and second corrugated strips 23 and 33 is a thin strip made of aluminum and has planar portions 23*b* or 33*b* and connecting portions (bent portions) 23*a* or 33*a* that are alternately continuously arranged to make a corrugation. Furthermore, as shown in FIGS. 1 and 6, first louvers 25 are formed in each planar portion 23*b* such that the first louvers 25 in each planar portion 23*b* are arranged in the lateral direction of the first corrugated strip 23 and are configured to be in asymmetry in the lateral direction. In other words, the first louvers 25 in each planar portion 23*b* are orientated obliquely in a first uniform direction relative to the base wall of the planar portion 23*b*. That is, the first louvers 25 have their openings 25*a* that are orientated obliquely relative to the base wall of the planar portion 23*b*. Thus, the first louvers 25 in each planar portion 23*b* are asymmetrical in the lateral direction about the center line C1 of the planar portion 23*b*.

Similarly, second louvers 35 are formed in each planar portion 33*b* such that the second louvers 35 in each planar portion 33*b* are arranged in the lateral direction of the first corrugated strip 23 and are configured to be in asymmetry in the lateral direction. In other words, the second louvers 35 in each planar portion 33*b* are orientated obliquely in a second uniform direction relative to the base wall of the planar portion 33*b*. That is, the second louvers 35 have their openings 35*a* that are orientated obliquely relative to the base wall of the planar portion 33*b*. Thus, the second louvers 35 in each planar portion 33*b* are asymmetrical in the lateral direction about the center line C2 of the planar portion 33*b*. In contrast, the first and second louvers 25 and 35 are symmetrical to each other about the perforated portion 40. Each of the first and second louvers 25 and 35 is formed by cutting the base wall of the planar portion 23*b* or 33*b* and by raising a predetermined portion of the base wall.

Figure 7:
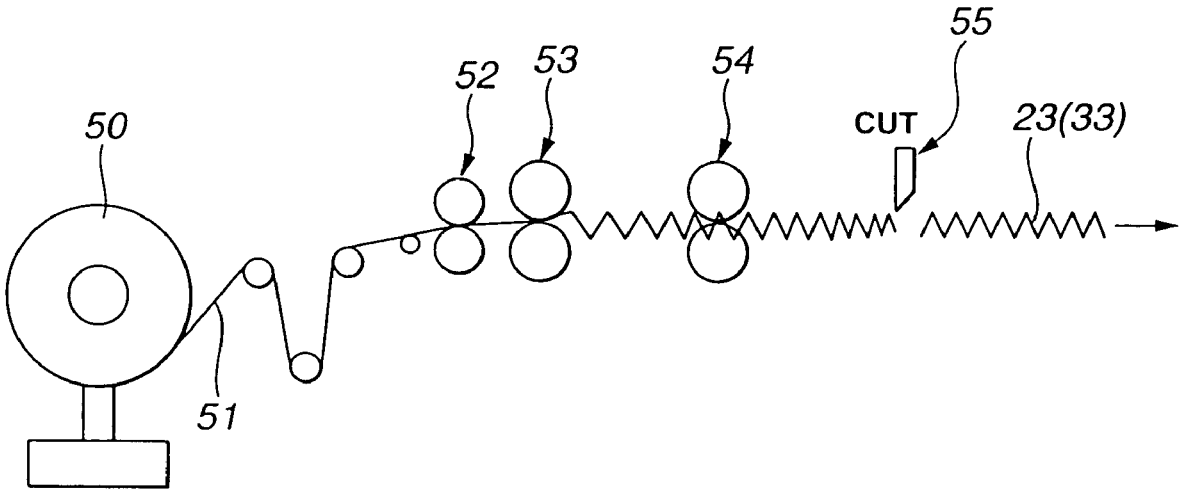
FIG. 7 is a schematic view showing steps for producing the louvered fin.

With reference to FIG. 7, a method for producing the louvered fin will be explained in detail in the following. At first, a blank 51 (in the form of thin strip or ribbon) of the louvered fin is taken from a roll 50. Then, the blank 51 is perforated by passing the blank 51 between a pair of perforation forming rollers 52, thereby perforating the blank 51 at regular intervals in a longitudinal direction of the blank 51. With this, there are provided a first blank of the first corrugated strip 23, a second blank of the second corrugated strip 33, and bridge members 40*a* each being provided between adjacent first and second perforations (slits) (see FIG. 8). After the perforation step, the blank 51 is passed between a pair of corrugation forming rollers 53. With this, the first and second louvers 25 and 35 are formed, and at the same time the blank 51 is shaped into a corrugated blank by bending the blank 51 at a position of each bridge member 40*a* in the lateral direction. The corrugation forming rollers 53 have a plurality of star-like gears (not shown in the drawings) that are meshed with each other by turning the corrugation forming rollers 53, for making a corrugation. Each star-like gear is formed with teeth for forming the first and second louvers 25 and 35. When the blank 51 is passed between the corrugation forming rollers 53, predetermined portions of the base wall of each planar portion 23*b* or 33*b* are cut and raised by the teeth of each star-like gear, thereby forming the first and second louvers 25 and 35.

When the corrugated blank is then passed between a pair of pitch adjusting rollers 54, the pitch of the corrugated blank (i.e., the distance between adjacent connecting portions 23*a* or 33*a*) is adjusted under a condition that the corrugated blank is compressed in the longitudinal direction. After that, the corrugated blank is cut to have a predetermined length. With this, the resulting louvered fin shown in FIG. 1 is formed with the first and second corrugated strips 23 and 33 attached with each other by the bridge members 40*a*.

As shown in FIG. 6, the first and second louvers 25 and 35 are respectively orientated in the first and second directions that are opposite to each other. In other words, the openings of the first louvers 25 are symmetrical to those of the second louvers 35 about the perforated portion 40.

Figure 8:
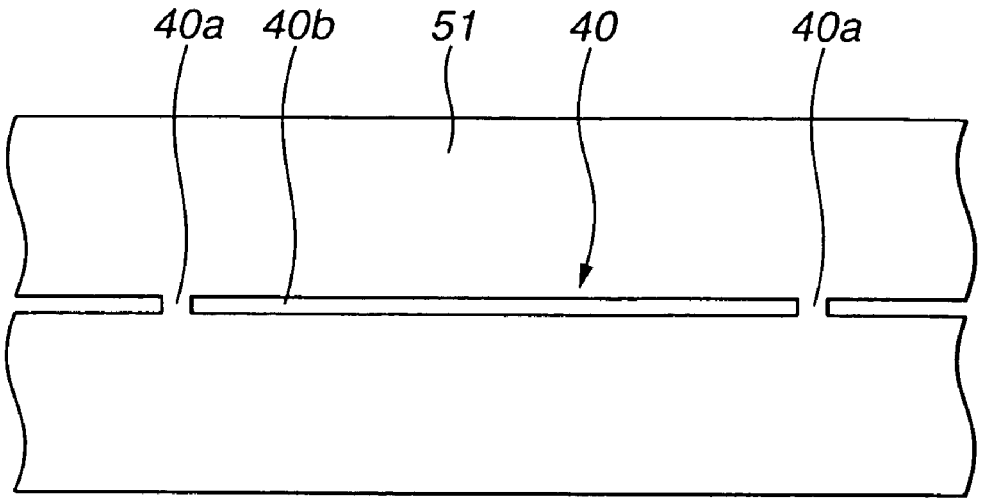
FIG. 8 is a plan view showing a blank of the louvered fin.

As shown in FIG. 8, the perforated portion 40 has bridge members 40*a* each defined by adjacent slits 40*b*. The bridge members 40*a* are formed at positions of connecting portions 23*a* and 33*a* at regular intervals (at every 8 connecting portions 23*a* and 33*a* in FIG. 1). The slit 40*b* may have a certain width (see FIGS. 1 and 8) or no width (not shown in the drawings) in the lateral direction. In the latter case, the slit 40*b* is a cut having no width. In this case, it is possible to get rid of wastes generated by preparing the slits of a certain width.

With reference to FIGS. 2-4, a method for producing a heat exchanger using the louvered fin will be explained in detail in the following. A first sandwiched structure is prepared by alternately disposing the first corrugated strips 23 and the tubes 22 and by putting reinforces 24 and 24*a* at both ends. As shown in FIG. 3, the first corrugated strip 23 at the top position is disposed between the reinforce 24 and the tube 22. Similarly, that at the bottom position is disposed between the reinforce 24*a* and the tube 22. The other first corrugated strips 23 are each disposed between corresponding two adjacent tubes 22. During the production of the first sandwiched structure, a second sandwiched structure is also prepared by substantially the same manner, thereby preparing an integral body of the first and second sandwiched structures. The first and second sandwiched structures, which are attached with each other through the bridge members 40*a*, are pre-assemblies of the first and second radiators 20 and 30. In the preparation of this integral body, all of the louvered fins are properly orientated such that all of the first louvers 25 of all the first corrugated fins 23 are orientated in a first uniform direction and such that all of the second louvers 35 of all the second corrugated fins 33 are orientated in a second uniform direction that is opposite to the first uniform direction (see FIG. 6).

Figure 9:
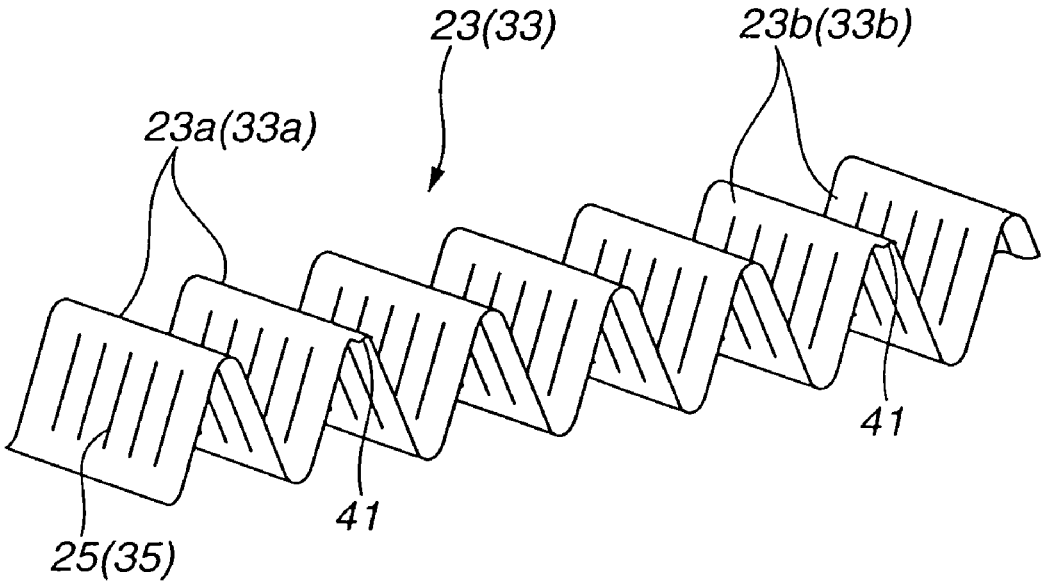
FIG. 9 is a perspective view showing a first corrugated strip having a fracture surface formed by detaching a straightening member from the first corrugated strip.

Then, the first and second sandwiched structures are detached from each other by breaking the bridge members 40*a* under a condition that upward and downward forces F are added to the first and second sandwiched structures in order to press the first and second corrugated strips 23 and 33 and the corresponding tubes 22 and 32 against each other. This detachment can be conducted by applying a vibration shock in the longitudinal direction of the louvered fins at a position corresponding to the bridge members 40*a*. By applying this vibration shock (shearing force), the first and second corrugated strips 23 and 33 are forced to move relative to each other, thereby easily breaking the bridge members 40*a*. With this, as shown in FIG. 9, each of the first and second corrugated strips 23 and 33 is formed at its one longitudinal side with fracture surfaces 41 when the first and second sandwiched structures are separated from each other.

After breaking the bridge members 40*a*, as shown in FIG. 4, the first and second structures are rotated relative to each other by about 90 degrees to make a cross-like shape. At this angular position, the first and second tanks 21 and 21*a* are attached to the first sandwiched structure, and the third and fourth tanks 31 and 31*a* are attached to the second sandwiched structure. In fact, the former attachment is conducted by inserting end portions of the tubes 22 and of the reinforces 24 and 24*a* into predetermined holes of the first and second tanks 21 and 21*a*, followed by brazing. Similarly, the latter attachment is conducted by inserting end portions of the tubes 32 and of the reinforces 34 and 34*a* into predetermined holes of the third and fourth tanks 31 and 31*a*, followed by brazing. Since the attachment of the first to fourth tanks is conducted at the above angular position, it is possible to provide a relatively large space near end portions of the tubes 22 or 32 (see FIG. 4). Therefore, it is possible to easily conduct this attachment without having intervention of the first or second tank 21 or 21*a* in the attachment of the third or fourth tank 31 or 31*a* and vice versa. Furthermore, it is possible to conduct this attachment in an assembly line with a small space.

Figure 10:
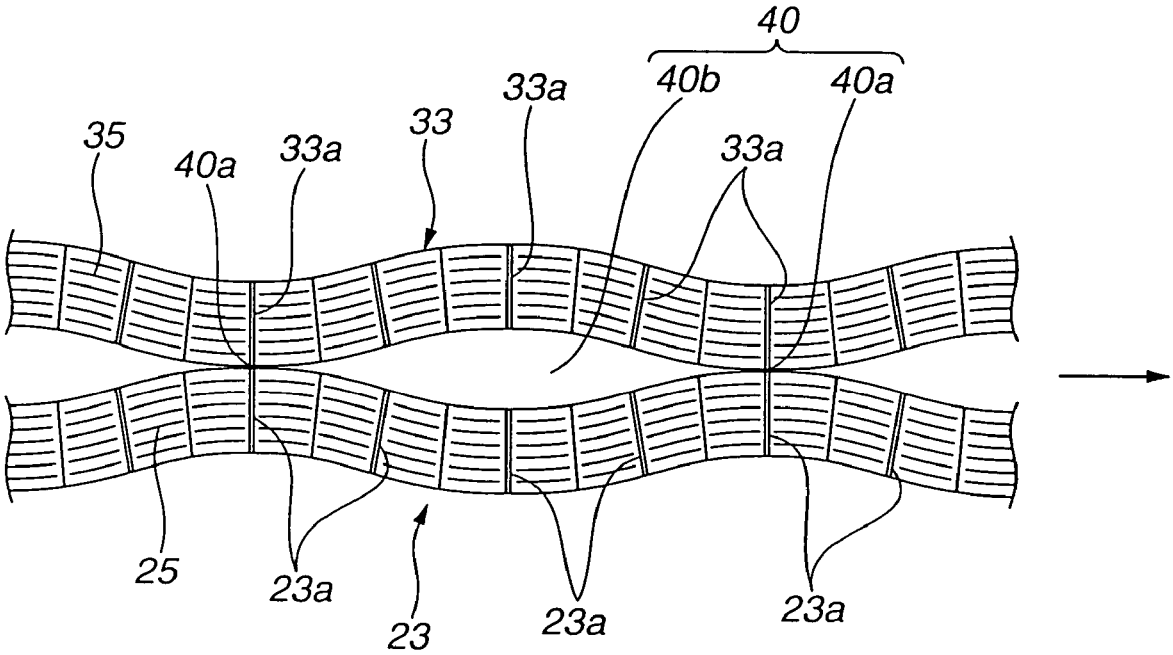
FIG. 10 is a plan view showing another blank of the louvered fin.

As mentioned above, the first and second corrugated strips 23 are put alongside of each other and attached with each other by the bridge members 40*a*. The first and second louvers 25 and 35 of all the first and second corrugated strips 23 and 33 are respectively orientated in a first uniform direction and a second uniform direction that is opposite to the first uniform direction. Therefore, as shown in FIG. 10, as long as the first and second corrugated strips 23 and 33 are attached with each other, the second corrugated strip 33 prevents the first corrugated strip 23 from curling in one direction, and the first corrugated strip 23 prevents the second corrugated strip 33 from curling in the other direction. In contrast with the present invention, if the first and second corrugated strips 23 and 33 are detached from each other under a condition that each of the first and second corrugated strips 23 and 33 is not fixed between two adjacent tubes, the first and second corrugated strips 23 and 33 tend to curl in one and the other directions, respectively. However, according to an embodiment of the present invention, the detachment is conducted under a condition that each of the first and second corrugated strips 23 and 33 is fixed between two adjacent tubes. Therefore, it is certainly possible to prevent curling of the first and second corrugated strips 23 and 33 and thereby to keep these strips in the straight form. This makes it possible to simultaneously conduct an automated assembly of the first and second radiators.

As mentioned above, it is possible to break the bridge members 40*a* by applying a vibration shock. Furthermore, this breaking can also be conducted by rotating the first and second sandwiched structures relative to each other by a predetermined angle in the longitudinal direction of the louvered fin. In this case, a relative rotational force acts as a shearing force on the bridge members 40*a*, thereby easily breaking the bridge members 40*a*.

As shown in FIG. 8, each bridge member 40*a* between two adjacent slits 40*b* has a relatively short width in the longitudinal direction of the louvered fin. Therefore, it is easily possible to break the bridge members 40*a* by applying shearing force. As is seen from FIG. 1, each bridge member 40*a* is formed between the laterally aligned connecting portions (bent portions) 23*a* and 33*a* of the first and second corrugated strips 23 and 33. These connecting portions 23*a* and 33*a* are greater than the planar portions 23*b* and 33*b* in rigidity. Therefore, it is possible to prevent deformation of the first and second corrugated strips 23 and 33 caused by applying a breaking load to the bridge members 40*a*, as compared with a case in which each bridge member is formed between the planar portions.

As mentioned above, it is possible to detach the first and second corrugated strips 23 and 33 from each other by breaking the bridge members 40*a*. By this breaking, each of the first and second corrugated strips 23 and 33 has a fracture surface only at one longitudinal side thereof. The other longitudinal side does not have such fracture surface. Therefore, the existence of this fracture surface makes it easy to recognize the proper orientation of the louvered fin. This also makes it possible to easily recognize the front or rear surface of the first and second radiators 20 and 30, thereby improving the assembly efficiency of these radiators.

As mentioned above, the openings 25*a* or 35*a* of the first or second louvers 25 or 35 are orientated in a uniform direction. Therefore, it is possible to prevent air from flowing in a meandering manner through the first or second corrugated strips 23 or 33. This provides a smooth air flow and increases the amount of air flowing therethrough, thereby improving heat exchange efficiency.

Figure 11A:
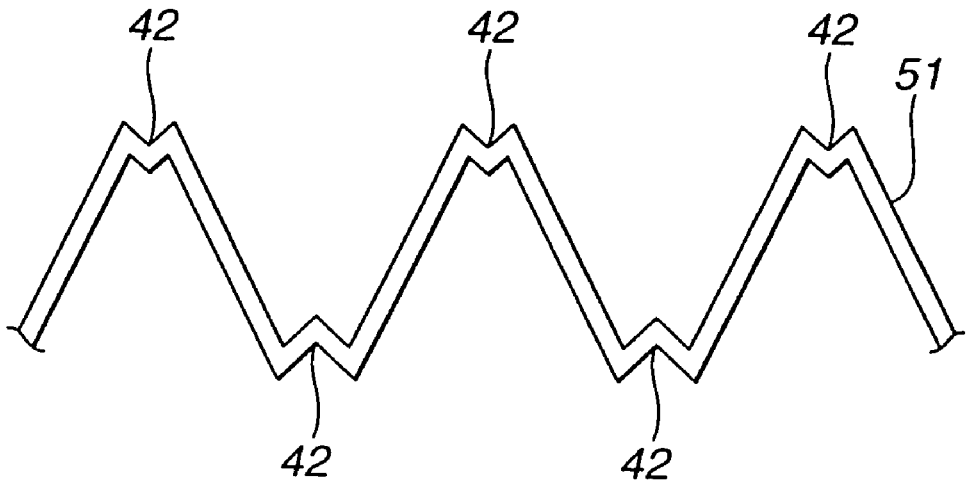
FIGS. 11(*a*) and 11(*b*) are side views showing sequential steps for forming a corrugated blank of the louvered fin in accordance with another embodiment of the present invention.
Figure 11B:
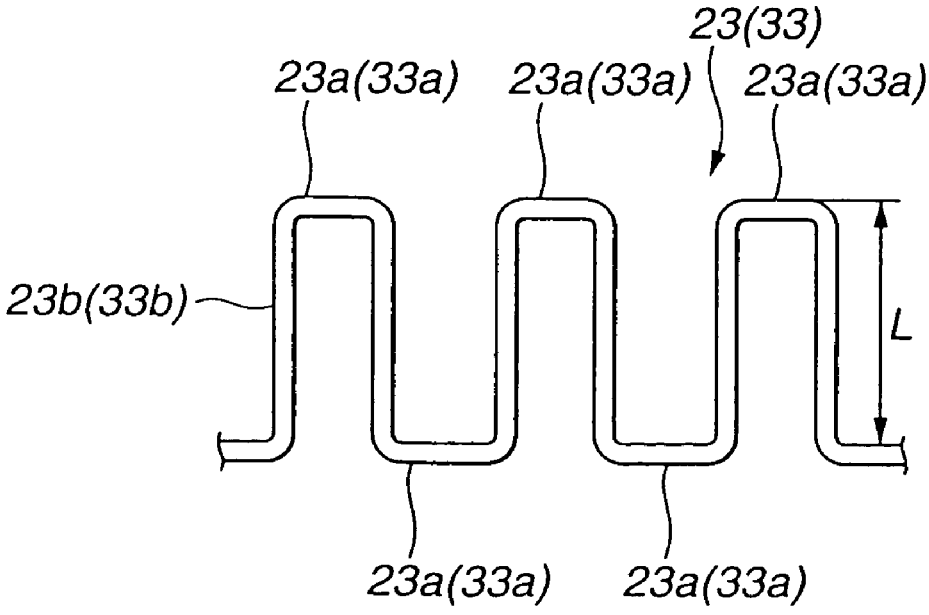

FIGS. 11(*a*) and 11(*b*) show sequential steps for forming a corrugated blank of the louvered fin in accordance with another embodiment of the present invention. According to this embodiment, a V-shaped portion (groove) 42 is formed at first at a position corresponding to each connecting portion 23*a* or 33*a* of the first and second corrugated strips 23 and 33 (see FIG. 11(*a*)). Then, each V-shaped portion 42 is straightened into the connecting portion 23*a* or 33*a* that is planar in shape (see FIG. 11(*b*)). This planar connecting portion 23*a* or 33*a* is improved in preventing deformation of the connecting portions when a breaking load acts on the bridge members 40*a*. Furthermore, the planar connecting portions 23*a* or 33*a* are capable of making the planar portions 23*b* or 33*b* longer in effective length L (see FIG. 11(*b*)), as compared with the case of arcuate connecting portions. Therefore, it is possible to make the widths of the first and second corrugated strips 25 and 35 longer, thereby making their opening areas greater. With this, it is possible to increase the amount of air flowing therethrough and to improve the heat exchange efficiency.

In the invention, the straightening member is not limited to the second corrugated strip 35. For example, the straightening member may be a ribbon having no louvers. In this case too, it is needless to say that the straightening member is attached to the first corrugated strip through the bridge member and is subjected to a separation from the first corrugated strip in the production of a heat exchanger, as described above.

The present invention is not limited to that the first or second louvers 25 or 35 in each planar portion 23*b* or 33*b* are orientated in a uniform direction (FIG. 6). For example, it is possible to design the first or second louvers 25 or 35 in each planar portion 23*b* or 33*b* such that the total opening area of the left half louvers in each planar portion 23*b* or 33*b* is different from that of the right half louvers in each planar portion 23*b* or 33*b*. In this case too, the first and/or second corrugated strips 23 and 33 tend to have the above-mentioned curling. Therefore, the present invention can be used in this case, too.

It is optional in the present invention to conduct a brazing between the first or second corrugated strip 23 or 33 and two adjacent tubes 22 or 32 and then to conduct a detachment of the first and second corrugated strips 23 and 33 from each other.

It is needless to say that a heat exchanger according to the present invention is not limited to the above-mentioned first and second radiators 20 and 30. For example, the heat exchanger may be a heater core or an evaporator in cooling cycle.

The entire disclosure of Japanese Patent Application No. 2001-024481 filed on Jan. 31, 2001, including specification, drawings, claims and summary, is incorporated herein by reference in its entirety.

What is claimed is:

1. A method for producing a heat exchanger, said method comprising the steps of:

(1) providing a louvered fin, said louvered fin comprising:

(a) a first corrugated strip having planar and connecting portions that are alternately arranged to make a corrugation, said first corrugated strip extending straight in a longitudinal direction;

(b) a plurality of first louvers formed in each planar portion such that said first louvers are arranged in a lateral direction perpendicular to said longitudinal direction, said first louvers in each planar portion being configured to be in asymmetry with respect to a center line of the planar portion in said lateral direction;

(c) a straightening member for keeping said first corrugated strip in a straight shape in said longitudinal direction, said straightening member extending along a longitudinal side of said first corrugated strip; and (d) a first bridge member for attaching said first corrugated strip and said straightening member together, (2) fixing said first corrugated strip between first and second adjacent tubes of said heat exchanger such that said first corrugated strip is kept in said straight shape by said first and second tubes; and (3) detaching said straightening member from said first corrugated strip by breaking said first bridge member such that there is provided a first sandwiched structure having said first corrugated strip fixed between said first and second tubes.

2. A method according to claim 1, wherein said louvered fin is prepared by a method comprising the steps of:

(4) providing a first blank of said first corrugated strip with said straightening member and said first bridge member such that said straightening member extends along a longitudinal side of said first blank and is attached to said first blank through said first bridge member;

(5) forming said first louvers in said first blank;

(6) shaping said first blank into a first corrugated blank; and (7) cutting each of said first corrugated blank and said straightening member to have a length in said longitudinal direction, thereby preparing said louvered fin.

3. A method according to claim 2, wherein, in the step (5), said first louvers are orientated in a first uniform direction.

4. A method according to claim 1, wherein said straightening member comprises:

a second corrugated strip extending along said longitudinal side of said first corrugated strip and having planar and connecting portions that are alternately arranged to make a corrugation; and a plurality of second louvers formed in each planar portion of said second corrugated strip such that said second louvers are arranged in said lateral direction and are symmetrical to said first louvers about said first bridge member.

5. A method according to claim 4, wherein said louvered fin is prepared by a method comprising the steps of:

(4) providing a first blank of said first corrugated strip with a second blank of said second corrugated strip and the first bridge member such that said second blank extends along a longitudinal side of said first blank and is attached to said first blank through said first bridge member;

(5) forming said first and second louvers respectively in said first and second blanks;

(6) shaping said first and second blanks respectively into first and second corrugated blanks; and (7) cutting each of said first and second corrugated blanks to have a length in said longitudinal direction, thereby preparing said louvered fin.

6. A method according to claim 5, wherein the step (4) is conducted by perforating a blank of said louvered fin at regular intervals in a longitudinal direction of said blank such that said first and second blanks are formed and such that said first bridge member is provided between adjacent first and second perforations formed by said perforating.

7. A method according to claim 6, wherein the step (6) is conducted by bending said first and second blanks at a position of said first bridge member in said lateral direction.

8. A method according to claim 5, further comprising the sequential steps of:

(8) fixing said second corrugated strip between third and fourth tubes to prepare a second sandwiched structure;

(9) rotating said first sandwiched structure, which has said first corrugated strip fixed between said first and second tubes, and said second sandwiched structure relative to each other by about 90 degrees to break said first bridge member;

(10) attaching first and second tanks to said first and second tubes; and

(11) attaching third and fourth tanks to said third and fourth tubes.

9. A method for producing a heat exchanger, said method comprising the steps of:

(1) providing a louvered fin, said louvered fin comprising:

(a) a first corrugated strip having planar and connecting portions that are alternately arranged to make a corrugation, said first corrugated strip extending straight in a longitudinal direction;

(b) a plurality of first louvers formed in each planar portion such that said first louvers are arranged in a lateral direction perpendicular to said longitudinal direction, said first louvers in each planar portion being configured to be in asymmetry with respect to a center line of the planar portion in said lateral direction;

(c) a straightening member for keeping said first corrugated strip in a straight shape in said longitudinal direction, said straightening member extending along a longitudinal side of said first corrugated strip; and (d) a first bridge member for attaching said first corrugated strip and said straightening member together, (2) fixing said first corrugated strip between first and second adjacent tubes of said heat exchanger such that said first corrugated strip is kept in said straight shape by said first and second tubes; and (3) detaching said straightening member from said first corrugated strip by breaking said first bridge member such that there is provided a first sandwiched structure having said first corrugated strip fixed between said first and second tubes.

wherein said straightening member comprises:

a second corrugated strip extending along said longitudinal side of said first corrugated strip and having planar and connecting portions that are alternately arranged to make a corrugation; and blanks;

a plurality of second louvers formed in each planar portion of said second corrugated strip such that said second louvers are arranged in said lateral direction and are symmetrical to said first louvers about said first bridge member, wherein said louvered fin is prepared by a method comprising the steps of:

(4) providing a first blank of said first corrugated strip with a second blank of said second corrugated strip and the first bridge member such that said second blank extends along a longitudinal side of said first blank and is attached to said first blank through said first bridge member;

(5) forming said first and second louvers respectively in said first and second (6) shaping said first and second blanks respectively into first and second corrugated blanks; and (7) cutting each of said first and second corrugated blanks to have a length in said longitudinal direction, thereby preparing said louvered fin, wherein each connecting portion of said first and second corrugated strips is prepared by straightening a V-shaped portion of each of said first and second blanks into a planar shape.

10. A method for producing a heat exchanger, said method comprising the steps of:

(1) providing a louvered fin, said louvered fin comprising:

(a) a first corrugated strip having planar and connecting portions that are alternately arranged to make a corrugation, said first corrugated strip extending straight in a longitudinal direction;

(b) a plurality of first louvers formed in each planar portion such that said first louvers are arranged in a lateral direction perpendicular to said longitudinal direction, said first louvers in each planar portion being configured to be in asymmetry with respect to a center line of the planar portion in said lateral direction;

(c) a straightening member for keeping said first corrugated strip in a straight shape in said longitudinal direction, said straightening member extending along a longitudinal side of said first corrugated strip; and (d) a first bridge member for attaching said first corrugated strip and said straightening member together, (2) fixing said first corrugated strip between first and second adjacent tubes of said heat exchanger such that said first corrugated strip is kept in said straight shape by said first and second tubes; and (3) detaching said straightening member from said first corrugated strip by breaking said first bridge member such that there is provided a first sandwiched structure having said first corrugated strip fixed between said first and second tubes, wherein the step (3) is conducted by applying a vibration to said louvered fin to break said first bridge member.

11. A method for producing a heat exchanger, said method comprising the steps of:

(1) providing a louvered fin, said louvered fin comprising:

(a) a first corrugated strip having planar and connecting portions that are alternately arranged to make a corrugation, said first corrugated strip extending straight in a longitudinal direction;

(b) a plurality of first louvers formed in each planar portion such that said first louvers are arranged in a lateral direction perpendicular to said longitudinal direction, said first louvers in each planar portion being configured to be in asymmetry with respect to a center line of the planar portion in said lateral direction;

(c) a straightening member for keeping said first corrugated strip in a straight shape in said longitudinal direction, said straightening member extending along a longitudinal side of said first corrugated strip; and (d) a first bridge member for attaching said first corrugated strip and said straightening member together, (2) fixing said first corrugated strip between first and second adjacent tubes of said heat exchanger such that said first corrugated strip is kept in said straight shape by said first and second tubes; and (3) detaching said straightening member from said first corrugated strip by breaking said first bridge member such that there is provided a first sandwiched structure having said first corrugated strip fixed between said first and second tubes.

wherein the step (3) is conducted by rotating said first sandwiched structure and said straightening member relative to each other to break said first bridge member.

* * * * *